US008680829B2

(12) United States Patent
Giroud

(10) Patent No.: US 8,680,829 B2
(45) Date of Patent: Mar. 25, 2014

(54) STABLE LOW DROPOUT VOLTAGE REGULATOR

(75) Inventor: Frederic Giroud, Neuchatel (CH)

(73) Assignee: CSEM Centre Suisse d'Electronique et de Microtechnique SA—Recherche et Developpement, Neuchatel (CH)

( * ) Notice: Subject to any disclaimer, the term of this patent is extended or adjusted under 35 U.S.C. 154(b) by 474 days.

(21) Appl. No.: 13/057,805

(22) PCT Filed: Aug. 5, 2009

(86) PCT No.: PCT/EP2009/060167
§ 371 (c)(1),
(2), (4) Date: Feb. 7, 2011

(87) PCT Pub. No.: WO2010/015662
PCT Pub. Date: Feb. 11, 2010

(65) Prior Publication Data

US 2011/0133707 A1 Jun. 9, 2011

(30) Foreign Application Priority Data

Aug. 8, 2008 (EP) ..... 08162053

(51) Int. Cl.
*G05F 1/40* (2006.01)

(52) U.S. Cl.
USPC ..... 323/280; 323/281

(58) Field of Classification Search
CPC ..... G05F 3/30
USPC ..... 323/273, 280, 281
See application file for complete search history.

(56) References Cited

U.S. PATENT DOCUMENTS

| | | | | |
|---|---|---|---|---|
| 6,465,994 | B1 | 10/2002 | Xi | |
| 6,614,280 | B1 * | 9/2003 | Panwitz | 327/307 |
| 7,173,401 | B1 * | 2/2007 | Huang | 323/277 |
| 7,723,968 | B2 * | 5/2010 | Okuyama et al. | 323/274 |
| 8,040,118 | B2 * | 10/2011 | Cho et al. | 323/273 |
| 2004/0164789 | A1 | 8/2004 | Leung et al. | |
| 2013/0147448 | A1 * | 6/2013 | Kadanka | 323/280 |

FOREIGN PATENT DOCUMENTS

EP 1111493 A1 6/2001

OTHER PUBLICATIONS

International Search Report, dated Nov. 4, 2010, from corresponding PCT application.
European Search Report, dated Nov. 19, 2008, from corresponding European application.

* cited by examiner

*Primary Examiner* — Matthew Nguyen
(74) *Attorney, Agent, or Firm* — Young & Thompson

(57) ABSTRACT

A Low-dropout (LDO) voltage regulator (1) includes: —a Ballast Transistor PBaI (3) of the P-channel MOS or Bipolar type, having a gate (34) and a main conduction path (D-S) connected in a path between the input $V_{DD}$ (4) and the output $V_{OUT}$ (5) of the regulator—an Operational Transconductance Amplifier (OTA) (2) being implemented as an adaptative biasing transistor amplifier and having an inverting input coupled to the output $V_{OUT}$ (5) through a voltage divider R1-R2 (61), a non-inverting input coupled to a voltage reference circuit (7) and having an output connected to the gate (34) of the Ballast transistor (3). To stabilize the output (5) and to increase the power supply rejection ratio (PSRR) of the LDO voltage regulator (1), OTA (2) includes a resistance $R_S$, which enables to stabilize the output (5) and to increase the Power Supply Rejection Ratio (PSRR).

20 Claims, 3 Drawing Sheets

STABLE LOW DROPOUT VOLTAGE REGULATOR

FIELD OF THE INVENTION

This invention relates generally to Low-dropout (LDO) voltage regulators comprising:

a Ballast Transistor of the P-channel MOS or bipolar type having a gate and a main conduction path (D-S) connected in a path between a supply voltage input $V_{DD}$ and a voltage output $V_{OUT}$ of the voltage regulator, and an Operational Transconductance Amplifier (OTA) being implemented as an adaptative biasing CMOS or Bipolar transistor amplifier and having an inverting input coupled to the output voltage $V_{OUT}$ through a voltage divider, a non-inverting input coupled to a voltage reference circuit and having an output connected to the gate of the Ballast transistor.

BACKGROUND OF THE INVENTION

Low-dropout (LDO) voltage regulators are commonly used to provide power to low-voltage digital circuits. As it is shown in FIG. 1, a LDO voltage regulator 1 is generally made of an Operational Transconductance Amplifier (OTA) 12 and a ballast transistor 13. The structure is in a closed loop with a reference like a bandgap voltage 14.

But, as for every closed-loop structure, a stability problem can occur, generating oscillations at the output. The study of the phase behavior in open loop provides precious information to avoid these oscillations. To get a good stability, the main condition is to keep the phase margin, which is the phase value at 0 dB of the open loop transfer function, above 60°.

A prior art structure of a LDO voltage regulator is shown in FIG. 2, where the OTA 12 is implemented like an adaptative biasing CMOS amplifier. In this configuration, if a capacitance of compensation 121 (Cc) and a bias current 122 ($I_0$) are not used, the output 15 ($V_{OUT}$) is only stable for null load capacitance 16 ($C_L$). But if this load capacitance 16 is null, the power supply rejection ratio (PSRR), which is the amount of noise from a power supply that an amplifier can reject, is very poor.

Otherwise, for non-zero load capacitance $C_L$ and null bias current $I_0$, this type of circuit can be used with a capacitance of compensation Cc that ensures stability. But the drawback of such use of compensation capacitances is the non-linear interdependence of the two poles of the open loop transfer function versus current load $I_{OUT}$. It can be noted that the frequency positions of these two poles affect directly the output stability. Consequently, the use of a capacitance of compensation Cc is useful only for very short output current range and deteriorates PSRR at specific frequencies.

Thus, this kind of configuration (FIG. 2) can difficulty reach stability, as it is commonly used with a high capacitance load $C_L$ (around 100 nF for a value of the load current $I_{OUT}$ around 1 mA).

An interesting solution to reach stability is disclosed in EP 1 111 493 wherein the OTA implemented is based on a Brokaw transconductance cell. This topology is quite different from the one implemented in the present invention, which implements an OTA as an adaptative biasing CMOS amplifier. Actually, a Brokaw transconductance cell merges the amplifier block with the bandgap voltage reference block. It achieves therefore lower quiescent current. The LDO voltage regulator reaches stability with the addition of a shunt capacitor at the counterphase input of the Brokaw transconductance cell and a base current compensation resistor. Unfortunately, this solution is limited to this topology. It also requires both a shunt capacitor and a compensation resistor to reach stability and can therefore definitely not be applied in an OTA as an adaptative biasing CMOS amplifier, used in the regulator according to the invention.

The present invention proposes a LDO voltage regulator arranged in such a way that these drawbacks can be avoided.

SUMMARY OF THE INVENTION

More precisely, the invention concerns a Low-Dropout voltage regulator as mentioned at the first paragraph, in which the OTA, implemented as an adaptative biasing transistor amplifier, comprises a resistance $R_S$, which enable to stabilize the output of the LDO voltage regulator and to increase the Power Supply Rejection Ratio (PSRR).

BRIEF DESCRIPTION OF THE DRAWINGS

The above and other objects, features, and advantages of the present invention will become further apparent from the following description of the preferred embodiment taken in conjunction with the accompanying drawings, in which.

DETAILED DESCRIPTION

Figure 1:
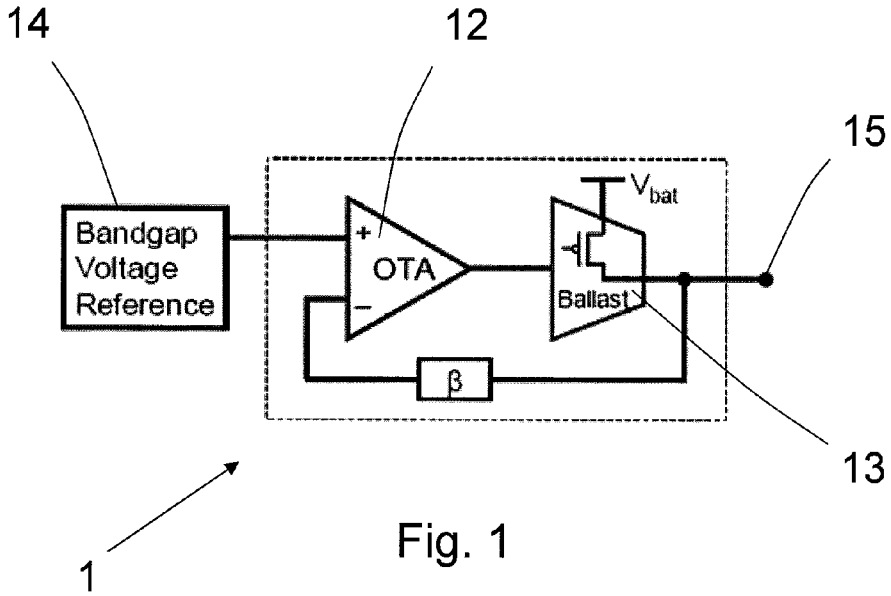
FIG. 1 is a schematic circuit diagram of the common structure of voltage regulators.
Figure 2:
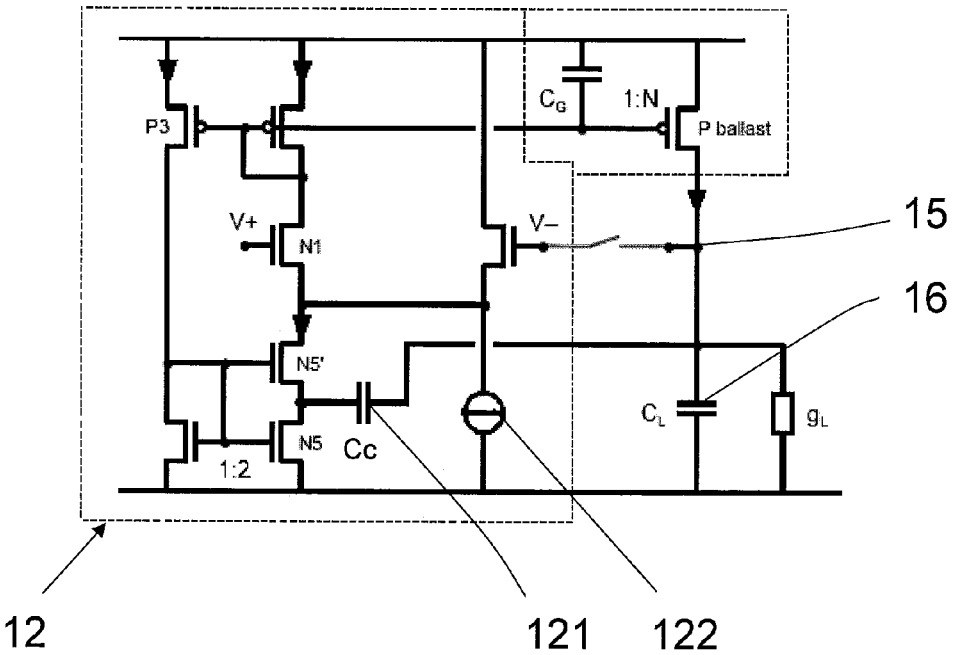
FIG. 2 is a detailed schematic circuit diagram of a prior art LDO voltage regulator comprising an OTA, implemented as an adaptative biasing CMOS amplifier, a ballast transistor PBaI and a regulation loop.
Figure 3:
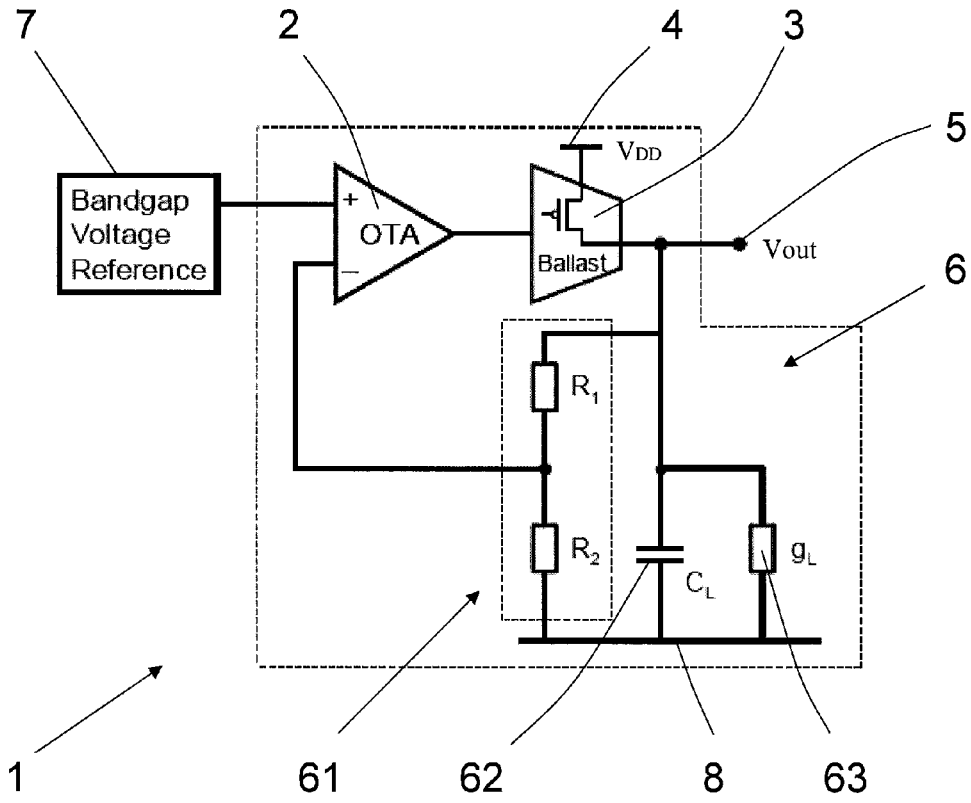
FIG. 3 is a schematic circuit diagram of the structure of the improved LDO voltage regulator according to the present invention.

FIG. 3 gives the general structure of a LDO voltage regulator 1 according to the present invention. It comprises an Operational Transconductance Amplifier (OTA) 2, a ballast transistor 3, a supply voltage $V_{DD}$ 4, an output voltage $V_{OUT}$ 5 and a regulation loop. The regulation loop comprises a voltage divider 61, made up of two resistances R1 and R2, and an output load represented by a capacitance 62 ($C_L$) and a conductance 63 ($g_L$) in parallel with the voltage divider 61. The ballast transistor 3 of the P-channel MOS type has a gate 34 (FIG. 4), which is coupled to the output of the OTA 2, and a main conduction path (D-S) connected in a path between the input $V_{DD}$ and the output $V_{OUT}$ of the regulator. It has to be noted that a ballast transistor is able to deliver high currents, typically an output current value around 1 mA.

The voltage divider 61 provides a feedback voltage $V_{IN}$ which is proportional to the output voltage $V_{OUT}$. The OTA 2 comprises an inverting input which is coupled to the voltage $V_{IN}$. The OTA 2 comprises further a non-inverting input coupled to a voltage reference circuit 7. This reference circuit 7 provides a voltage value $V_{REF}$ and may be a bandgap circuit.

A LDO voltage regulator works as follow. The OTA compares the voltage reference $V_{REF}$ and the feedback voltage $V_{IN}$ (which is representative of the output voltage $V_{OUT}$) and provides an appropriate output control signal to the gate 34 of the transistor 3. According to the value of the voltage provided by the OTA 2 and applied on the gate 34, the transistor 3 will conduct more or less current though its conduction path, in such a way that the output voltage 5 ($V_{OUT}$) will be increased or reduced, according to the value of the difference between $V_{REF}$ and $V_{IN}$, to keep the same output voltage value.

Figure 4:
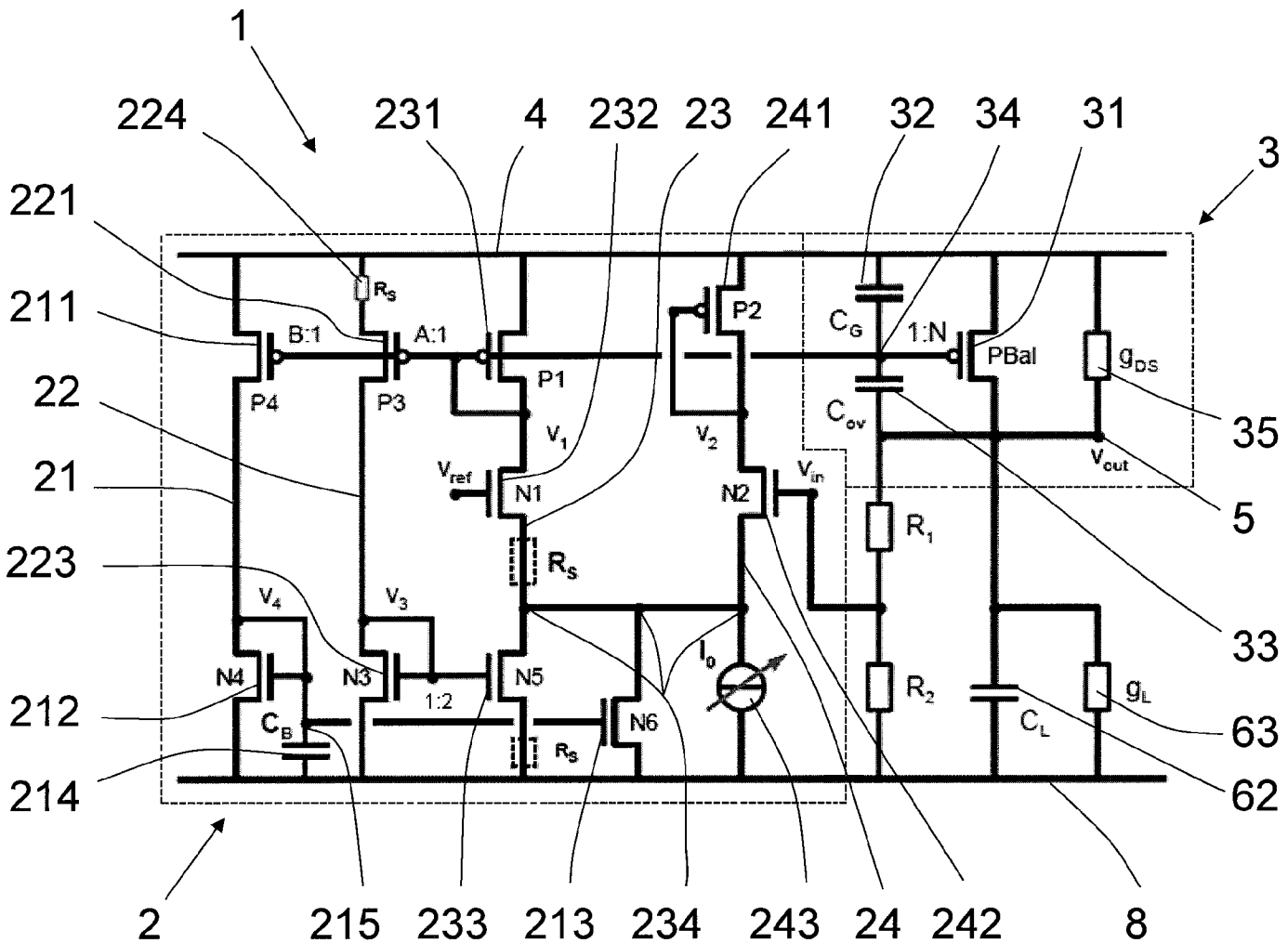
FIG. 4 is a detailed schematic circuit diagram of the circuit of FIG. 3, showing simultaneously several possible configurations.

FIG. 4 shows a detailed schematic circuit diagram of the LDO voltage regulator 1 according to the present invention. It presents the internal structure of the OTA 2, which is implemented as an adaptative biasing CMOS amplifier. The elements already described above in connection with the prior art LDO will be referenced with the same numbers.

On a branch 22 of the LDO voltage regulator 1 is arranged a transistor PMOS 221 (P3), the source of which is connected to the supply voltage 4. The transistor 221 forms a current mirror configuration with a transistor PMOS 231 (P1) which is arranged on a branch 23 of the OTA 2, mounted in diode. This current mirror configuration has an internal constant factor A, the ratio of the mirror.

The drain of the transistor 221 is connected to the drain of a transistor NMOS 223 (N3) mounted in diode and which forms a current mirror configuration with a transistor NMOS 233 (N5). This current mirror configuration has an internal constant factor 2. Sources of transistors 223 and 233 are both connected to the ground 8 of the LDO voltage regulator 1. The drain of the transistor 233 is connected to the source of a transistor NMOS 242 (N2), arranged on a branch 24 of the OTA 2, via a node 234.

On the branch 23 of the OTA 2, a transistor NMOS 232 (N1) presents a drain which is connected to the drain of the transistor 231. Its source is connected to the source of the transistor 242, via the node 234. The voltage gate of the transistor 232, which corresponds to the non-inverting input of the OTA, is connected to the voltage reference $V_{REF}$. The structure built by transistors N1 and N2 is the active input of the OTA 2, usually called the differential pair.

A transistor PMOS 241 (P2) mounted in diode is arranged on the branch 24 of the OTA 2 between the drain of the transistor 242 and the supply voltage 4, similarly to the transistor PMOS 231 (P1) with the drain of the transistor 232 and the supply voltage 4. Its function is to generate on N2 similar electric effects than those generated by P1 on N1, for symmetry.

The voltage gate of the transistor 242, which corresponds to the inverting input of the OTA, is connected to the feedback voltage $V_{IN}$.

In the FIG. 4, the ballast transistor 3 is represented with elements which don't appear in FIG. 3. These elements are intrinsic parasites of the real device needed in mathematical simulations to model the real behavior of the ballast transistor. So they are not added on the real electronic device. The present representation of the ballast transistor 3 comprises, besides the ballast transistor 31 of the P-channel MOS type (PBaI) itself, a capacitance 32 ($C_G$) (called gate capacitance), a capacitance 33 ($C_{OV}$) (called overlap capacitance), both of them simulating the capacitive effects created by the internal structure of the real transistor, and a conductance 35 ($g_{DS}$) arranged in parallel with the ballast transistor 31. This ballast transistor 31 forms a current mirror configuration with the transistor 231. This current mirror configuration has an internal constant factor N.

The aim of the LDO voltage regulator 1, according to the present invention, is to act on both poles of the open loop transfer function $H_{Open\ Loop}(j\omega)$, which is the ratio $V_{OUT}/V_{IN}$ (when R1 and R2 are put away) and on the open loop DC gain. By controlling these two poles and their frequency positions, stability can be ensured (by keeping the phase margin above 60°) and the power supply rejection ratio (PSRR) can be optimized because it is roughly proportional to the open loop DC gain.

For the following calculations, and especially for the transconductances calculation, the transistors are supposed to be in weak inversion. But the principle is extensible to moderate and strong inversion, as well for bipolar structures. The model used here for the CMOS transistors is the EKV (Enz-Krummenacher-Vittoz) model, which is a scalable and compact simulation built on fundamental properties of the MOS structure. Particularly, this model is dedicated to the design and simulation of low-voltage and low-current analog circuits using submicron CMOS technologies.

The way to control the open loop transfer function $H_{Open\ Loop}$ and consequently its two poles is to modify the current flowing through the transistor 242. To achieve this goal, several ways are possible.

A first solution is to arrange a current source 243 ($I_0$) between the node 234 and the ground 8 of the OTA 2. Such a bias current $I_0$ is often used to activate LDO voltage structures. It has been remarked that it also may be used to improve the output stability and the PSRR. Thus, the current $I_0$, flowing through transistor 242 only, allows controlling the open loop DC gain and the second pole of $H_{Open\ Loop}$, simply by tuning its intensity. Consequently the stability and the PSRR can be optimized. The current $I_0$ value should be around 1/10 of $I_{OUT}/N$ and constant. In this configuration, the open loop gain $H_{Open\ Loop}$ can be approximated by ($C_{OV}$ is neglected):

$$H_{Open\ Loop}(j\omega) = \frac{\frac{-g_M^2}{N}}{(g_L + g_{DS} + j\omega \cdot C_L) \cdot (g_{m0} + j\omega \cdot C_G \cdot (A + B))}$$

In this equation, $g_M = I_{OUT}/nU_T$ and $g_{DS} = I_{OUT}/V_{early}$ are respectively the transconductance and the drain-source conductance of the ballast transistor 31, $g_{m1} = g_M/N$ is the transconductance of transistor 232, $g_{m0} = I_0/nU_T$ is the contribution of $I_0$ in the transconductance of the transistor 242, which is $g_{m2} = g_{m1} \cdot (A+B-1) + g_{m0}$. Terms n, $U_T$ and $V_{early}$ are intrinsic characteristics of transistors NMOS and PMOS used in the LDO voltage regulator 1; n is called "slope factor" or "body effect" and is roughly equal to 1.3 and $U_T$ is the thermodynamic potential equal to 26 mV at 27° C. Both poles are approximated by $g_L/C_L$ and $g_{m0}/C_G$. Consequently, they can be controlled by $C_L$ and $I_0$. This solution allows to size a regulator for any given load capacitance. Thus good stability and PSRR can be controlled by setting $I_0$ at the optimal value. The main drawback of this solution is that, as $I_0$ is fixed and sized for a given load current $I_{OUT}$, stability is limited up to a maximal current, and PSRR is limited down to a minimal current. This structure works very well on about 2 octaves of current. For biggest range of $I_{OUT}$, $I_0$ has to be programmable. Furthermore, it can be noticed that $I_0$ will introduce a positive offset voltage at the output which will be most of time negligible since $I_0$ does not need to be very high to reach stability. This offset appears for low output current.

A second solution to optimize stability and PSRR would be to complete the OTA 2 with a branch 21 comprising a transistor PMOS 211 (P4), which forms a current mirror configuration with the transistor 231. This current mirror configuration has an internal constant factor B. The source of the transistor 211 is connected to the supply voltage 4 and its drain is connected to the drain of a transistor NMOS 212 (N4) which forms a current mirror configuration with a transistor NMOS 213 (N6). This current mirror configuration has an internal constant factor of 2 (similarly to transistor 223 and 233). The drain of the transistor 213 is connected to the source of the transistor 242 (N2), via the node 234. Sources of transistors 212 and 213 are both connected to the ground 8 of the LDO voltage regulator 1. Then a capacitance $C_B$ is arranged between the node 215 (located between gates of transistors 212 and 213) and the ground 8. This capacitance $C_B$ allows creating an equivalent $I_0$ current by slowing down a ratio of the feedback current $I_{OUT}/N$, which flows through the transistor 211 and the branch 21 of the LDO voltage regulator 1. By choosing a value of 1/10 for the ratio B, the value of the generated current is roughly equal to 1/10 of $I_{OUT}/N$. Preferentially, the ratio A value is chosen in such a way that A+B be roughly equal to 1, to get a minimal output offset voltage. This created current has the same effects on output stability and PSRR as the $I_0$ current described in the first arrangement above. With the same parameters as described above, the open loop transfer function is approximated by ($C_{OV}$ is neglected):

$$H_{Open\ Loop}(j\omega) = \frac{\frac{-g_M^2}{N}}{[g_L + g_{DS} + j\omega \cdot C_L] \cdot \left[\frac{B \cdot g_{m1}}{1 - j \cdot \frac{B \cdot g_{m1}}{\omega \cdot C_B}} + j\omega \cdot C_G \cdot (A + B)\right]}$$

The two poles of this open loop transfer function are approximated by $g_L/C_L$ and $B \cdot g_{m1}/C_G$. Consequently, they can be controlled by $C_L$ and B, if $C_B$ is high enough to neglect the term $(B \cdot g_{m1}/\omega \cdot C_B)$. Thus, the capacitance $C_B$ may have to be high (from 50 pF to 200 pF). Yet, even if this solution presents the advantage of not being limited in current, it is difficult to arrange such elements with high values in such integrated circuits, so the use of a big capacitance $C_B$ will not be a preferential solution here. It can be remarked that if this arrangement is not applied, the branch 21 becomes useless and can be removed from the OTA 2. Moreover the ratio A will be equal to 1.

A third and preferred solution is to arrange a resistance $R_S$ in the OTA 2. The current provided from the branch where the resistance $R_S$ is arranged will be modified. Then, by flowing through the transistor 242, it will act on the open loop transfer function $H_{Open\ Loop}$ (jω), more precisely on the second pole and on the open loop DC gain which respectively control the stability and the PSRR. Effects produced by this current are similar to those obtained by using a current source $I_0$, as it is described above. The resistance $R_S$ can be arranged in the OTA 2 among three possible positions.

In a first arrangement, the resistance $R_S$ is placed between the source of the transistor 221 and the supply voltage 4. Consequently, the current flowing through the transistor 221 and the branch 22 is modified. Then, at the node 234 (after the transit in the current mirror configuration comprising transistors 223 and 233 and which introduces a factor 2), a part of the current flows toward the transistor 242. In this configuration, the resistance $R_S$ leads to a factor A on stability.

In a second arrangement, the resistance $R_S$ is placed under the source of the transistor 233. Consequently, the current drain of the transistor 233 is modified. Then a part of this current flows through the transistor 242 and will lead to a factor 2 on stability.

In a third arrangement, the resistance $R_S$ is placed under the source of the transistor 232. Consequently, the current flowing through the branch 23 and the transistor 232 is modified and it will lead to a factor n (small n is meant here, the slope factor) on stability when it will flow through the transistor 242.

The open loop transfer function $H_{Open\ Loop}$(jω) has been approximated when $R_S$ is arranged under the source of the transistor 232, but the following equations are very good approximations too for the two other positions of the resistance $R_S$. For the same parameters that those which have been used previously, the open loop transfer function is approximated by:

$$H_{Open\ Loop}(j\omega) = \frac{\frac{-g_M^2}{N}}{(g_L + g_{DS} + j\omega \cdot C_L) \cdot (n \cdot g_{m1}^2 \cdot R_S + j\omega \cdot C_G \cdot (A + B))}$$

The first pole is still the same as previously $g_L/C_L$. The second pole is approximated by $(R_S \cdot g_{m1}{}^2/C_G)$. So, they can be controlled by $C_L$ and $R_S$. Yet, the second pole becomes negligible at low output current because it depends on the square of $g_{m1}$ which is proportional to $I_{OUT}$. It means that stability increases with current and degrades itself at small and even null current.

The arrangement where $R_S$ is placed under the source of the transistor 221 is the best disposition among the three described above. Indeed, drain-source voltages in transistors 232 and 242 have to be roughly the same. This symmetry voltage is ensured by the transistor 241 in case that the drain-source conductance of the transistor 232 would become insufficient. Thus, if $R_S$ is arranged under the transistor 232, it creates an imbalance in this symmetry voltage which can deteriorate the PSRR at the output. Moreover, by arranging the resistance $R_S$ under sources of transistors 232 or 233, it creates a voltage drop in the branch 23, which can prevent the transistor 233 from working correctly (the transistor overloading, also called transistor saturation, could become impossible in this case). It can be noticed that $R_S$ introduces a negative offset voltage (which appears for high output current) at the output which will be mostly negligible since $R_S$ values do not need to be very high to reach stability.

To sum up, the arrangement implementing $R_S$ shows the best results in view of output stability and PSRR. Moreover, it is the arrangement in which $R_S$ is disposed under the source of the transistor 221, which will be preferred to the other embodiments comprising the current source $I_0$, the capacitance $C_B$ and the resistance $R_S$ arranged under sources of transistors 232 or 233.

Yet, any of the three arrangements of $R_S$ can be used alone or in combination with the current source $I_0$, described as a first way to act on stability and the open loop DC gain. Preferentially, they will often be associated. Indeed, the combination of these two elements has a strong interest by enlarging output current range, since $I_0$ gives a limit of maximum current and $R_S$ gives a limit of minimum current for stability of the loop. The capacitance $C_B$ could be also used in combination with these two elements, in such a way that the open loop transfer function of the system would be approximated by:

$$H_{Open\ Loop}(j\omega) = \frac{\frac{-g_M^2}{N}}{[g_L + g_{DS} + j\omega \cdot C_L] \cdot \left[g_{m0} + \frac{B \cdot g_{m1}}{1 - j \cdot \frac{B \cdot g_{m1}}{\omega \cdot C_B}} + n \cdot g_{m1}^2 \cdot R_S + j\omega \cdot C_G \cdot (A + B)\right]}$$

In this equation, the three contributions of $I_0$, $C_B$ and $R_S$ appear.

If the capacitance $C_B$ is not used (in the preferred arrangement), the ratio N can be chosen around 50 and the $C_L$ value around 100 nF. Then, on the one hand, the current $I_0$ is increased until the phase margin reaches 32°-35° and on the other hand, the resistance $R_S$ is increased until the phase margin reaches 60°-65°. This is done for most probable output current $I_{OUT}$, for example 1 mA. This operation can be remade if the PSRR is too low, by choosing a higher $C_L$ value (for example 1 uF) or by decreasing the ratio N. It can be noticed that PSRR is maximal for the chosen output current, here 1 mA, and degrades around 5 dB for other currents values. Stability is ensured for any output current (lower or higher) and any $C_L$ value higher than that chosen at beginning (100 nF or 1 uF here in the example).

The embodiment above described, in accordance with drawings, has been implemented by using CMOS type transistors. Yet, bipolar transistors can also be implemented instead of CMOS transistors (it comprises also the ballast transistor 3). In these conditions the results concerning stability and the PSRR will be the same than those obtained above.

The invention claimed is:

1. A Low-DropOut (LDO) voltage regulator having one input $V_{DD}$ adapted to receive a supply voltage, an output $V_{OUT}$ adapted to deliver a regulated output voltage and a ground, said voltage regulator comprises:

a Ballast Transistor, having a gate and a main conduction path (D-S) connected in a path between the input $V_{DD}$ and the output $V_{OUT}$ of the regulator, and an Operational Transconductance Amplifier (OTA) being implemented as an adaptative biasing transistor amplifier and having an inverting input coupled to the output $V_{OUT}$ through a voltage divider, a non-inverting input coupled to a voltage reference circuit and having an output connected to the gate of the Ballast transistor, wherein the OTA furthermore comprises a resistance $R_S$, which enables to stabilize the output and to increase the Power Supply Rejection Ratio (PSRR).

2. The Low-DropOut voltage regulator of claim 1, wherein the resistance $R_S$ enables to control one of the two poles of the open loop function transfer of the Low-DropOut voltage regulator, which is given by:

$$H_{Open\ Loop}(j\omega) = \frac{\frac{-g_M^2}{N}}{(g_L + g_{DS} + j\omega \cdot C_L) \cdot (n \cdot g_{m1}^2 \cdot R_S + j\omega \cdot C_G \cdot (A + B))}$$

in which $g_M = I_{OUT}/nU_T$ and $g_{DS} = I_{OUT}/V_{early}$ are respectively the transconductance and the drain-source conductance of the ballast transistor, $g_{m1} = g_M/N$ is the transconductance of a first transistor, the grid of which is coupled to the voltage reference circuit, the conductance $g_L$ and the capacitance $C_L$ represent an output load, $I_{OUT}$ is the output current, $C_G$ is an internal capacitance of the ballast transistor and N, A and B are coefficients of internal current mirror configurations which are comprised in the Low-DropOut voltage regulator, terms n, $U_T$ and $V_{early}$ are intrinsic characteristics of transistors used, n is called "slope factor", and $U_T$ is the thermodynamic potential.

3. The Low-DropOut voltage regulator of claim 1, wherein the resistance $R_S$ is arranged in the OTA between the input $V_{DD}$ and the source of a second transistor, said second transistor forming a current mirror configuration with a third transistor, the source of which is connected to the input $V_{DD}$ and the drain of which is connected to the drain of the first transistor, the drain of said second transistor being coupled to the drain of a fourth transistor.

4. The Low-DropOut voltage regulator of claim 2, wherein the resistance $R_S$ is arranged in the OTA between the input $V_{DD}$ and the source of a second transistor, said second transistor forming a current mirror configuration with a third transistor, the source of which is connected to the input $V_{DD}$ and the drain of which is connected to the drain of the first transistor, the drain of said second transistor being coupled to the drain of a fourth transistor.

5. The Low-DropOut voltage regulator of claim 1, wherein the resistance $R_S$ is arranged in the OTA between the source of the first transistor and an internal node where are connected the drain of a fifth transistor and the source of a sixth transistor, the source of said fifth transistor being connected to the ground, and said fifth transistor forming a current mirror configuration with a fourth transistor, the source of which is linked to the ground.

6. The Low-DropOut voltage regulator of claim 2, wherein the resistance $R_S$ is arranged in the OTA between the source of the first transistor and an internal node where are connected the drain of a fifth transistor and the source of a sixth transistor, the source of said fifth transistor being connected to the ground, and said fifth transistor forming a current mirror configuration with a fourth transistor, the source of which is linked to the ground.

7. The Low-DropOut voltage regulator of claim 5, wherein the grid of the sixth transistor is coupled to the output $V_{OUT}$ through the voltage divider, the drain of said sixth transistor being coupled to the drain of a seventh transistor, mounted in diode, the source of which is connected to the input $V_{DD}$.

8. The Low-DropOut voltage regulator of claim 6, wherein the grid of the sixth transistor is coupled to the output $V_{OUT}$ through the voltage divider, the drain of said sixth transistor being coupled to the drain of a seventh transistor, mounted in diode, the source of which is connected to the input $V_{DD}$.

9. The Low-DropOut voltage regulator of claim 1, wherein the resistance $R_S$ is arranged in the OTA between the source of a fifth transistor and the ground of the Low-DropOut voltage regulator.

10. The Low-DropOut voltage regulator of claim 2, wherein the resistance $R_S$ is arranged in the OTA between the source of a fifth transistor and the ground of the Low-DropOut voltage regulator.

11. The Low-DropOut voltage regulator according to claim 1, wherein a current source $I_0$ is arranged in the OTA.

12. The Low-DropOut voltage regulator of claim 11, wherein said current source $I_0$, combined with the resistance $R_S$, enables to control one of the two poles of the open loop function transfer of the Low-DropOut voltage regulator, which is given by:

$$H_{Open\ Loop}(j\omega) = \frac{\frac{-g_M^2}{N}}{[g_L + g_{DS} + j\omega \cdot C_L] \cdot \left[g_{m0} + \frac{B \cdot g_{m1}}{1 - j \cdot \frac{B \cdot g_{m1}}{\omega \cdot C_B}} + n \cdot g_{m1}^2 \cdot R_S + j\omega \cdot C_G \cdot (A + B)\right]}$$

in which $g_{m0}=I_0/nU_T$ is the contribution of $I_0$ in the transconductance of a sixth transistor the grid of which is coupled to the output $V_{OUT}$ through the voltage divider and $C_B$ is a capacitance.

13. The Low-DropOut voltage regulator of claim 11, wherein the current source $I_0$ is arranged between the node and the ground.

14. The Low-DropOut voltage regulator of claim 12, wherein the current source $I_0$ is arranged between the node and the ground.

15. The Low-DropOut voltage regulator according to claim 1, wherein transistor implemented in the OTA as an adaptative biasing transistor amplifier and the ballast transistor are of CMOS type.

16. The Low-DropOut voltage regulator according to claim 1, wherein transistor implemented in the OTA as an adaptative biasing transistor amplifier and the ballast transistor are of bipolar type.

17. The Low-DropOut voltage regulator according to claim 2, wherein a current source $I_0$ is arranged in the OTA.

18. The Low-DropOut voltage regulator according to claim 3, wherein a current source $I_0$ is arranged in the OTA.

19. The Low-DropOut voltage regulator according to claim 4, wherein a current source $I_0$ is arranged in the OTA.

20. The Low-DropOut voltage regulator according to claim 5, wherein a current source $I_0$ is arranged in the OTA.

* * * * *